United States Patent [19]

Dettinger et al.

[11] Patent Number: 4,527,957

[45] Date of Patent: Jul. 9, 1985

[54] PISTON PUMP

[75] Inventors: Willi Dettinger; Hugo Fries, both of Urach, Fed. Rep. of Germany

[73] Assignee: URACA Pumpenfabrik GmbH & Co. KG, Urach, Fed. Rep. of Germany

[21] Appl. No.: 562,401

[22] Filed: Dec. 16, 1983

Related U.S. Application Data

[63] Continuation-in-part of Ser. No. 258,755, Apr. 29, 1981, abandoned.

[30] Foreign Application Priority Data

Jun. 6, 1980 [DE] Fed. Rep. of Germany ..... 3021851
Jun. 9, 1981 [JP] Japan ..... 56-87582

[51] Int. Cl.[3] ..... F04F 11/00
[52] U.S. Cl. ..... 417/92; 417/900
[58] Field of Search ..... 417/92–98, 417/900; 92/86.5

[56] References Cited

U.S. PATENT DOCUMENTS

| | | | |
|---|---|---|---|
| 995,042 | 6/1911 | Stuehck | 417/92 |
| 1,051,410 | 1/1913 | Howard | 417/92 |
| 1,159,201 | 11/1915 | Ferraris | 417/92 |
| 1,697,682 | 1/1929 | Ferraris | 417/92 |
| 1,702,867 | 2/1929 | Heiny | 417/98 |
| 3,215,087 | 11/1965 | McLeod | 417/92 X |
| 3,241,496 | 3/1966 | Imai et al. | 417/98 |
| 3,602,613 | 8/1971 | Gunther | 417/437 |
| 4,086,029 | 4/1978 | Crane et al. | 92/86.5 |

*Primary Examiner*—Edward K. Look
*Attorney, Agent, or Firm*—Michael J. Striker

[57] ABSTRACT

A piston pump has suction and pressure valves, a valve through-chamber extending between the valves, a working chamber with a piston reciprocal therein, and a force-transmitting chamber communicating with the working chamber and accommodating a force-transmitting medium, wherein the valve through-chamber and the force-transmitting chamber are formed as parts of a common chamber and located adjacent to one another.

30 Claims, 7 Drawing Figures

PISTON PUMP

CROSS-REFERENCE TO A RELATED APPLICATION

This application is a continuation-in-part of application Ser. No. 258,755, filed Apr. 29, 1981 now abandoned.

BACKGROUND OF THE INVENTION

The present invention relates to a piston pump. More particularly, it relates to a high pressure piston pump particularly for aggressive and/or abrasive and sometimes hot flow medium.

Piston pumps of the above-mentioned general type are known in the art. A known piston pump has a valve through-chamber extending from a suction valve to a pressure valve, a working chamber in which a piston reciprocates, and a force-transmitting chamber connecting the valve-through chamber with the working chamber and accommodating a force transmitting medium which transmits the energy stroke of the piston to the flow medium and at the same time separates the flow medium from the piston.

In such a piston pump the force transmitting chamber is formed by a substantially S-shaped force-transmitting conduit with a vertical section whose inner chamber corresponds at least the magnitude of the piston displacement. A supply line for the force-transmitting medium is located in the vicinity of the working chamber, and the force-transmitting medium fills the force-transmitting chamber at the end of the pressure stroke of the piston, substantially to the lower part of the vertical section. The loss of the force-transmitting medium is replenished by respective supply. The working chamber and the piston are provided with shields for separating the valve through-chamber and the flow medium.

Pumps having force-transmitting chambers can be advantageously utilized for many substances, instead of diaphragm pumps. They have special advantages in the cases when they supply a liquid which must be separated from the seals of the piston, for example a plunger piston, because the liquid or its components provide for solvent or abrasive action. The chemical industry makes the requirement of the utilization of such liquids in extensive range. These liquids include, for example, carbamate, chemical liquids such as fatty alcohols or the like with admixed catalysts, suspensions and so on. As a force-transmitting medium, a liquid is utilized which does not mix with the flow medium.

The known pumps of the above-mentioned type have relatively long conduits and units which are separated from one another, whereby these pumps are bulky and heavy which make difficult their utilization. Further, the force-transmitting conduits, particularly in high pressure pumps, are subjected to the action of alternative forces and thereby material fatigue can take place which is facilitated by the angled shape of the force-transmitting conduit. Moreover, it has been noticed during flow of the hot flow medium that the heat load of the force-transmitting conduit undesirably affects its strength and resistance.

SUMMARY OF THE INVENTION

Accordingly, it is an object of the present invention to provide a piston pump which avoids the disadvantages of the prior art.

More particularly, it is an object of the present invention to provide a piston pump which has a relatively simple construction and spatially favorable dimensions, and at the same time has high resistance to pressure variations and temperature.

In keeping with these objects and with others which will become apparent hereinafter, one feature of the present invention resides, briefly stated, in a piston pump which has a force-transmitting chamber and a valve through-chamber which chambers are parts of a common chamber and arranged adjacent to one another. The force-transmitting chamber and the valve through-chamber may be separated from one another by wall means and located laterally adjacent to one another or inside one another, preferably completely inside one another.

When the piston pump is designed in accordance with the present invention, it suffices to arrange the valve through-chamber and the force-transmitting chamber in a single pressure-tight chamber, whereby the number of pressure loaded parts are considerably reduced. The walls which subdivide the common chamber into the valve through-chamber and the force-transmitting chamber are loaded to a very small extent inasmuch as the walls at their both sides are loaded by practically identical pressures. The piston pump in accordance with the present invention can have a compact construction which allows high variable loads and temperature loads and is not susceptibel to vibrations.

It is important that between the connection of the force-transmitting chamber with the working chamber of the piston and the connection of the force-transmitting chamber with the valve through chamber, a vertical height differential takes place. This prevents that the portion of the flow medium can be displaced, under the action of the gravity force and mixed with the force transmitting medium, to the piston.

In accordance with another advantageous feature of the present invention, the force-transmitting chamber and the valve through-chamber are concentrical or substantially concentrical to one another.

In accordance with still another feature of the present invention, a pipe is provided which bounds the valve through-chamber and is at least partially surrounded by the force-transmitting chamber, and at the same time has a lower open end communicating with the force-transmitting chamber. The force-transmitting chamber can thereby annularly surround the valve through-chamber. Such a construction may be easily carried out when the pipe is inserted in an upper opening of a housing block which forms the above-mentioned common chamber, and sealed from the force-transmitting chamber.

Yet another feature of the present invention is that the pipe can be axially fixed to a valve housing of one of the valves or to a guiding part of the same and sealed against the force-transmitting chamber. The valves may be mounted on or inserted in the housing block.

When the flow media have a tendency to gasification, it is advantageous when the valve through-chamber is connected with the force-transmitting chamber, in accordance with the present invention, by a labyrinth-like connecting chamber which extends between an open upper end of the valve through-chamber to an open lower end of the force-transmitting chamber. This connecting or mixing chamber prevents filling of vapor or gas bubbles formed in the flow medium to the force-transmitting medium. Otherwise, the compressible vapor or gas bubbles makes ineffective the piston operation. The gas bubbles also accumulate in the vicinity of the pressure valve so that during the pressure stroke of the piston they travel from the valve through-chamber through the pressure valve into the pressure conduit.

In accordance with still a further feature of the present invention, the connecting or mixing chamber can be located concentrically between the valve through-chamber and the force-transmitting chamber.

Yet a further feature of the present invention resides in that the above-mentioned chambers are formed by two oppositely open pipes which are located in one another so that the inner pipe bounds the valve through-chamber inside the same, the outer part bounds the force-transmitting chamber outside the same, and the connecting or mixing chamber is formed between these two pipes. The inner pipe is open upwardly, whereas the outer pipe is open downwardly and axially overlaps the inner pipe. The labyrinth-like subdivision of the common chamber makes possible to provide for a very simple construction. The oppositely open pipes can be secured in upper and lower openings of the housing block, preferably with inter-position of the seals. The valve casing parts of the suction valve and/or pressure valve, or guiding parts connected with the valve may axially secure the pipes in a simple manner.

The suction valve and the pressure valve may be arranged axially or substantially coaxially relative to the valve through-chamber at its upper and lower ends in the region of upper and lower openings of the common chamber of the housing block. Thereby a rectilinear flow of the pump medium is attained, so that the danger of whirl formation and conglommeration of solid components of the pump medium is considerably reduced.

A particularly compact and load bearing construction of the inventive piston pump can be attained when the housing block contains the pump valve. This can be attained by directly containing the pump valve in the housing block or by insertion of components of the valve into the housing block.

Preferably, the suction valve and the pressure valve are arranged on the housing block so that they are accessible from above or sometimes from the side.

In accordance with a further feature of the present invention, when a flow medium is utilized which has a strong tendency to form deposits, it is advantageous when the suction valve and/or the pressure valve have valve members which act in closing direction under the action of gravity. In other words, the valves have members which are not spring biassed. The preferable shape of the valve members is a ball-shape, since it has favorable flow characteristics and thereby a lower tendency to make deposits.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
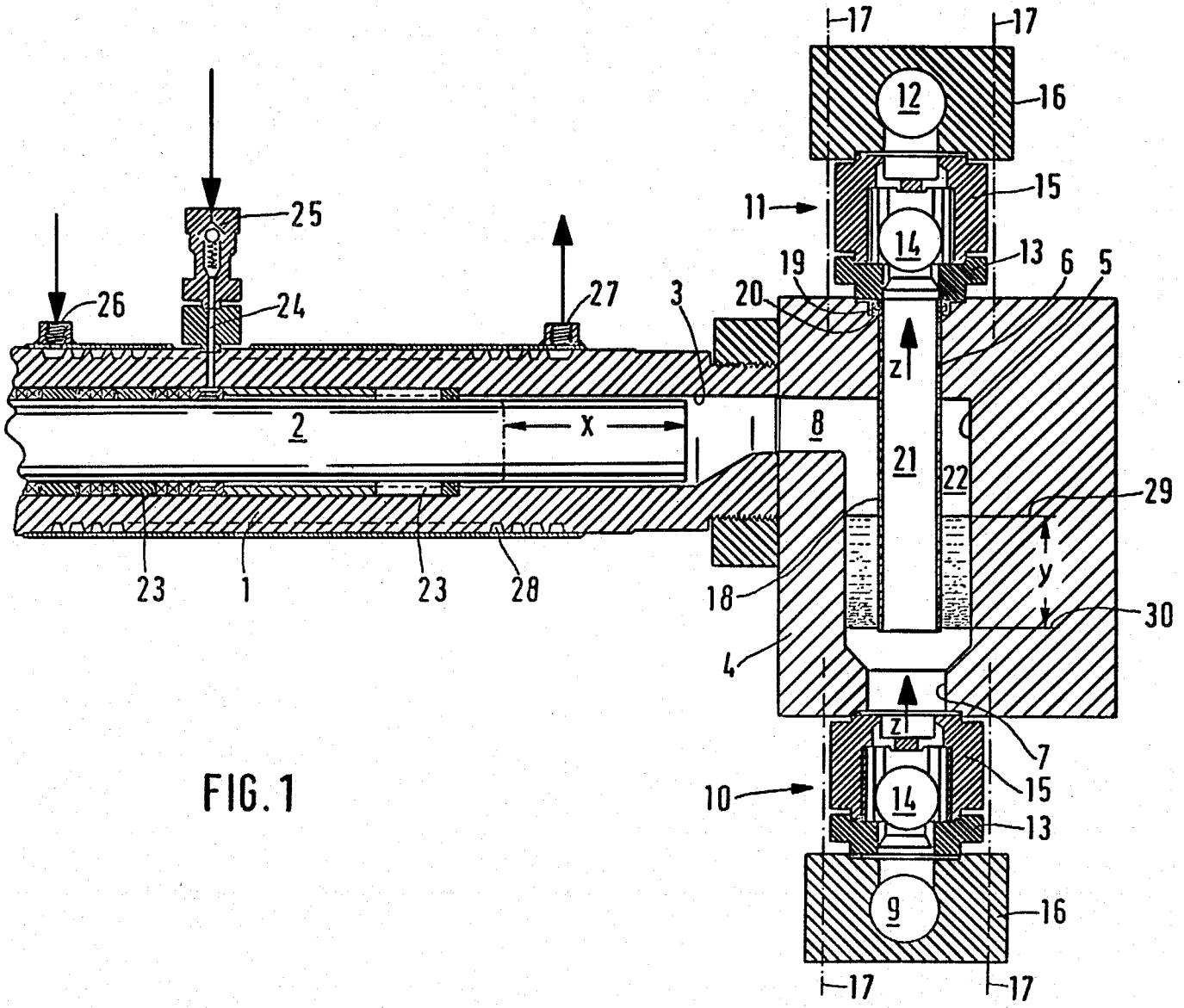
FIG. 1 is a view showing a section of a piston pump in accordance with one embodiment of the present invention.

A piston pump in accordance with the present invention has a pump cylinder 1 and a piston 2 which reciprocates in the pump cylinder 1, as shown in FIG. 1. In order to perform a piston stroke, the piston 2 displaces to the right; in order to perform a suction stroke, it displaces to the left in FIG. 1. Thereby, the piston decreases or reduces the volume of a piston working chamber 3.

The pump cylinder 1 is connected with a circular housing block 4, for example by screws. The housing block 4 has a cylindrical chamber 5 provided with an upper opening 6 and a lower opening 7. The chamber 5 and its openings 6 and 7 are coaxial to one another. A transverse opening 8 located in the upper region of the chamber 5 communicates the working chamber 3 with the chamber 5.

A suction valve 10 is arranged in the region of the lower opening 7 of the chamber 5 and communicates the same with a suction conduit 9. A pressure valve 11 is arranged in the region of the upper opening 6 and leads to a pressure conduit 12.

Each of the valves 10 and 11 has a two-part valve housing including a valve seat part 13 which forms a valve seat and a cage part 15 which guides a valve ball 14. As can be seen from the drawing, the valves 10 and 11 may be identical. The housings of the valves may be connected with the housing block 4 by identical pressing members 16 in which the suction conduit 9 and the pressure conduit 12 are received, and by schematically shown tightening screws 17.

An upwardly open circular pipe 18 is inserted in the upper opening 6 of the housing block 4. The pipe 18 is axially secured in upward direction by the valve seat part 13 of the pressure valve 11, and in downward direction by a shoulder 19 provided on the pipe 18. The shoulder 19 is received in an annular recess 20 which forms an extension of the upper opening 6 of the housing block 4.

The pipe 18 subdivides the chamber 5 into a circular valve through chamber 21 and a circular force-transmitting chamber 22 which concentrically surrounds the first-mentioned chamber.

The force-transmitting chamber 22 is filled with a force-transmitting medium during operation of the pump. The pump is provided with a supply conduit 24 in which a return valve 25 is arranged, and which is opened between seals 23 of the piston 2. The force-transmitting medium can travel through the supply conduit 24 to the seals 23 in the working chamber 3 and from there travel into the force-transmitting chamber 22. Leakage loss of the force-transmitting medium is compensated by additional supply, for example during the suction stroke of the piston 2.

A slight amount of force-transmitting medium will be pumped together with the flow medium to the pressure conduit 12. For compensation of the losses, additional force-transmitting medium is introduced through supply conduit 24 and return valve 25. In this context it is to be noted that the provision of the supply conduit 24 and the valve 25 in vicinity of the sealings 23 inherents the advantages that upon introduction of the force-transmitting medium, any contaminations which penetrate to the working chamber 3 and to the sealings 23 during operation of the pump are entrained with the force-transmitting medium so as to provide a cleaning effect. Thus, the sealings 23 are cleaned, and contaminations which sometimes penetrate into the working chamber 3 are displaced in direction toward the force-transmitting chamber 22 and subsequently in the connecting region between the latter and the valve through-chamber 21.

In highly loaded pumps, the pump cylinder 1 can be provided with a forced cooling, for example with the aid of a cooling conduit 28 which is spiral-shaped and extends between a cooling medium inlet 26 and a cooling medium outlet 27.

The pump in accordance with the present invention operates in the following manner:

The force-transmitting medium accommodated in the working chamber 3 and in the force-transmitting chamber 22 transmits the work of the piston 2 to the flow medium accommodated in the valve through-chamber 21. During the suction stroke of the pump, the flow medium flows through the suction valve 10 into the force-transmitting chamber 22. The boundary layer between the force-transmitting medium and the flow medium at the end of the suction stroke is located at a higher level 29, and at the end of the pressure stroke is located at a lower level 30. In both cases it seals from above the lower opening of the pipe 18 inside the force-transmitting chamber 22. The boundary layer between the both media oscillates in correspondence with the movement of the piston 2 between the levels 29 and 30 as identified by the double headed arrow Y. The flow medium, for example a coal paste, is permanently accommodated in the pipe 18.

During the pressure stroke of the piston 2, the flow medium expelled from the force-transmitting chamber 22 travels through the pressure valve 11 into the pressure conduit 12. The flow medium extends through the valve through-chamber 21 in direction of the arrow Z.

Figure 2:
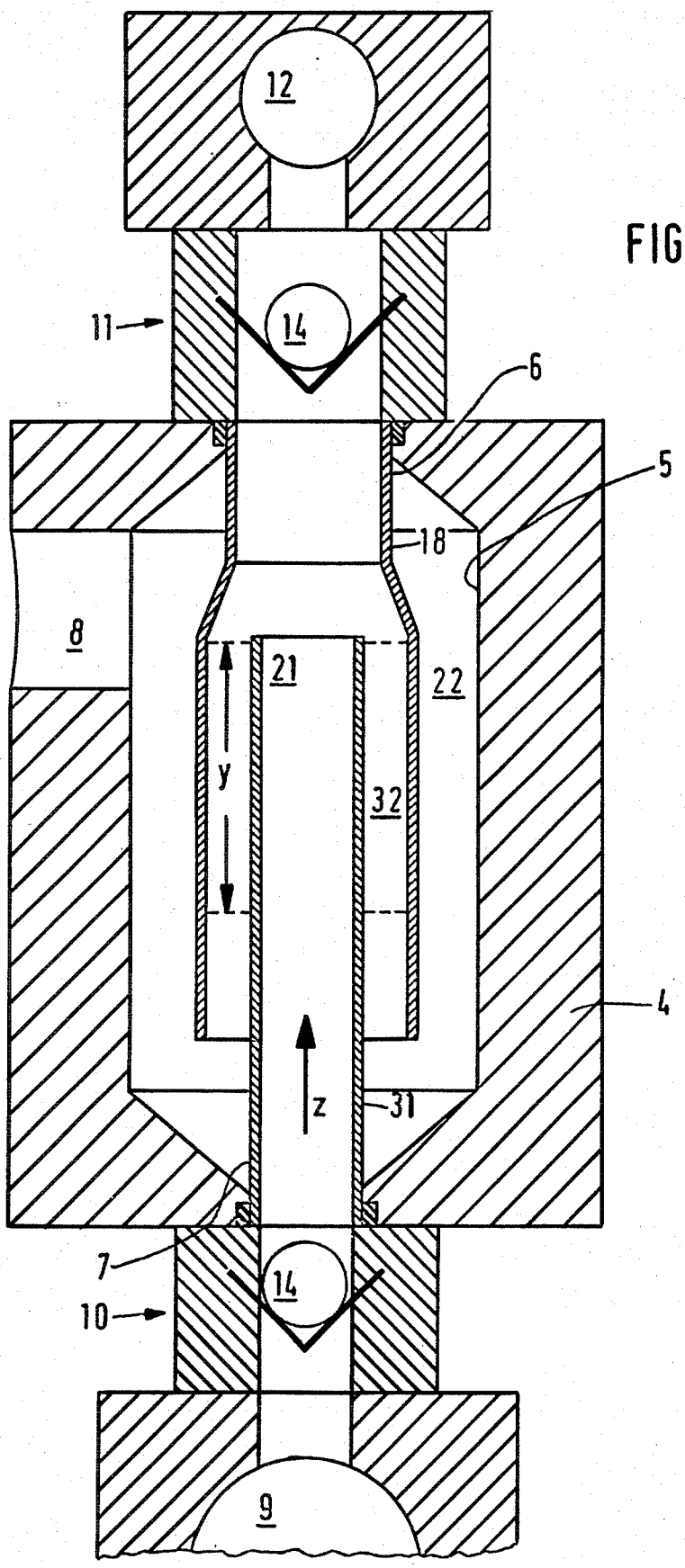
FIG. 2 is a view showing a section of a piston valve in accordance with another embodiment of the present invention, including a mixing chamber.

FIG. 2 schematically shows the piston pump in accordance with another embodiment of the invention. The piston pump of FIG. 2 distinguishes from the piston pump of FIG. 1 in that an upwardly open pipe 31 is inserted into the lower opening 7 of the chamber 5. The pipe 31 extends inwardly of the pipe 18 which is inserted in the upper opening 6 of the chamber 5. An annular connecting or mixing chamber 32 is formed between the pipes 18 and 31.

In such a construction, the entire force-transmitting chamber 22 located outside of the pipe 18 is permanently filled with force-transmitting medium both during the pressure stroke and the suction stroke. The boundary layer between the force-transmitting medium and the flow medium oscillates inside the mixing chamber 32 in correspondence with the double headed arrow Y. If in the flow medium, vapor bubbles or gas bubbles are formed, they collect because of its small density below the pressure valve 11 and are moved during the next pressure stroke into the pressure conduit 12. The danger of gas or vapor accumulation in the force-transmitting chamber 22 is thereby eliminated.

The valves 10 and 11 shown in FIGS. 1 and 2 are located directly above and below the chamber 5. They have valve bodies formed as valve balls 14 and acting under the action of their weight so as to sit on a respective valve seat. Because of this arrangement of the valves 10 and 11, the flow medium flows from below upwardly in direction of the arrow Z through the valve through-chamber 21.

Figure 3:
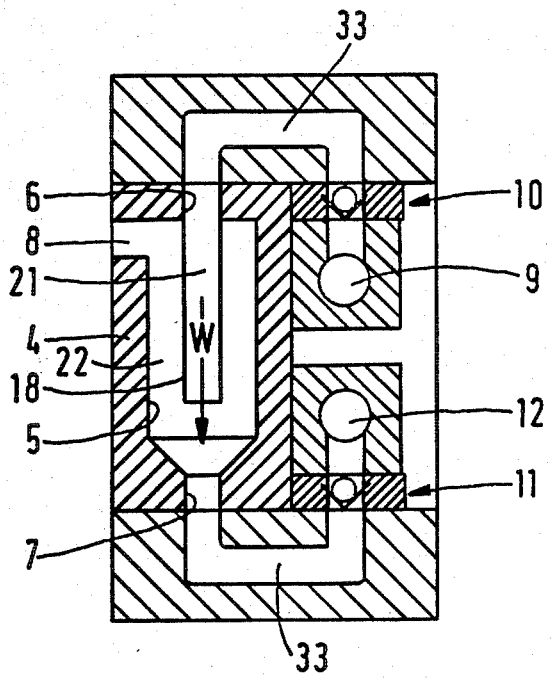
FIGS. 3 and 4 are views showing arrangements of valves of the piston pump in accordance with the present invention.

As can be seen from FIG. 3, the valves 10 and 11 may be connected with the chamber 5 by U-shaped connecting conduits 33. The suction valve 10 is connected by the connecting conduit 33 with the upper opening 6 of the chamber 5, whereas the pressure valve 11 is connected by the connecting conduit 33 with the lower opening 7 of the chamber 5.

In this construction, the flow medium flows through the valve through-chamber 21 from above downwardly in correspondence with the arrow W. This also allows the utilization of the valve which operate in closing direction under the action of the weight of the valve bodies. The thus operating valves are advantageous especially in the cases when there is a tendency for making deposits, inasmuch as in this construction no valve springs located in a flow medium are needed.

The flow direction according to the arrow W from above downwardly is advantageous in the cases when mud with solid particles tending to sink must be pumped, inasmuch as the natural sinking movement of the solid particles corresponds to the flow direction of the pressure valve.

Figure 4:
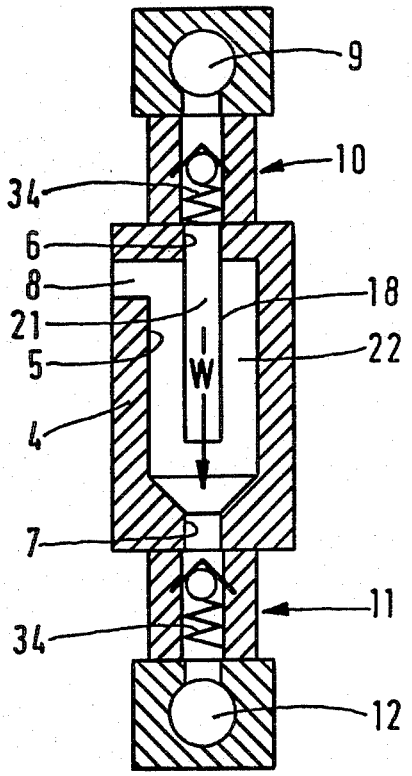

When it is possible to provide valve springs 34, as shown in FIG. 4, a flow direction from above downwardly through the valve through-chamber can be attained by the valves 10 and 11 which are directly arranged above and below the housing block 4. The arrangements of the valves shown in FIGS. 3 and 4 can also be provided in the piston pump in accordance with FIG. 2.

In the above-described piston pump, the transverse opening 8 extending laterally from the force-transmitting chamber 22 of the chamber 5 to the working chamber 3, is located above the lower opening of the pipe 18 which separates the force-transmitting chamber 22 inside the chamber 5. This arrangement is always important in the cases when the flow medium or its aggressive components have a higher density than the force-transmitting medium. When, however, the force-transmitting medium possesses a higher density than the flow medium or its components, there can be the danger that a portion of the flow medium penetrates into the force-transmitting medium and travels into the working chamber 3. Since in this case the flow medium because of its smaller density can float on the force-transmitting medium, a reverse arrangement of the pump including interchange of up and down of the pump is advantageous.

Figure 5:
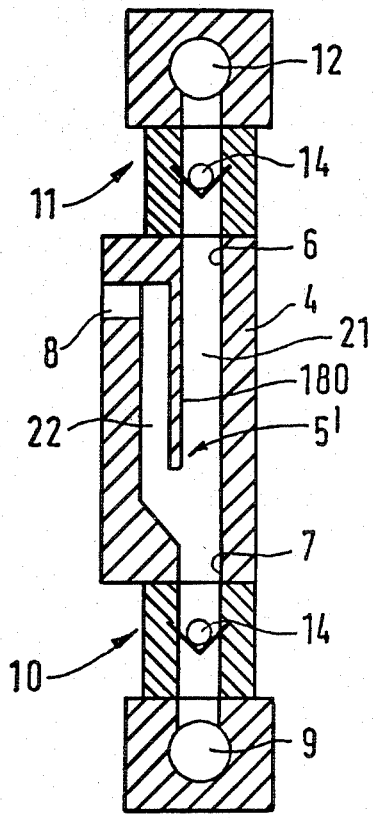
FIGS. 5 to 7 are views showing the piston pump in accordance with further embodiments of the invention.

FIG. 5 shows a piston pump in which the valve through-chamber 21 and the force-transmitting chamber 22 are located laterally adjacent to one another and separated by a wall 180. These chambers are parts of a common chamber 5' provided in the housing block 4.

Figure 6:
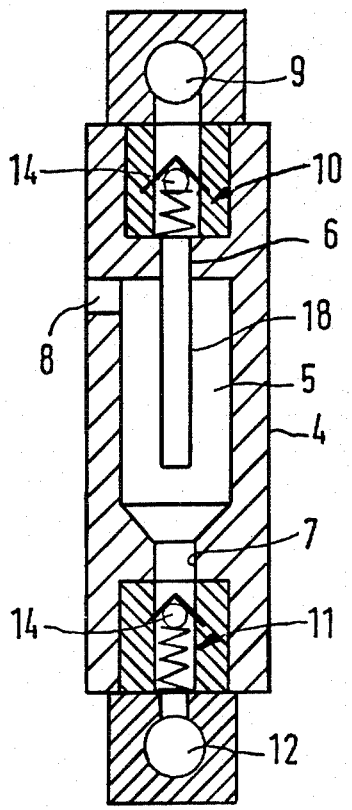

FIG. 6 shows a piston pump which substantially corresponds to the piston pump of FIG. 4, but in which the suction valve 10 and the pressure valve 11 are inserted in the housing block 4.

Figure 7:
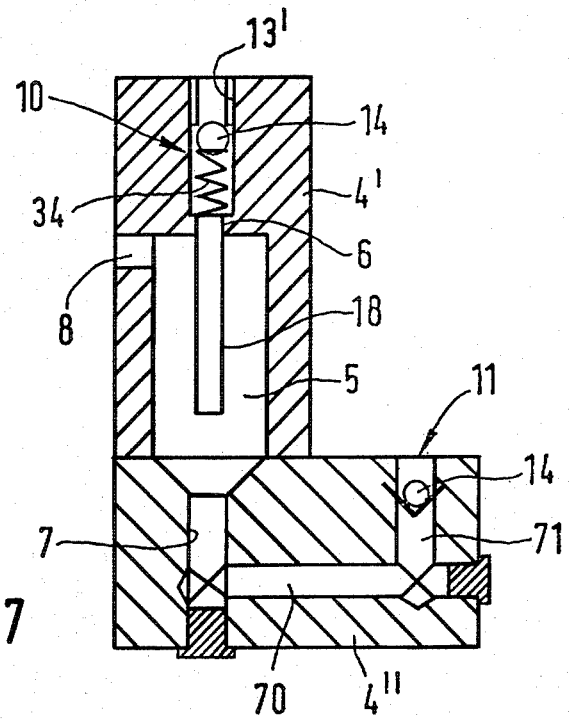

FIG. 7 shows that the suction valve 10 and the pressure valve 11 may be arranged directly in the housing block and accessible from above. The housing block here is composed of two housing part 4' and 4''. The valve ball 14 of the suction valve 10 is urged by the valve spring 34 against a valve seat part 13'. The valve seat part 13' is arranged in a hole which is formed in the housing part 4' and is an extension of the upper opening 6 of the chamber 5. The lower opening 7 of the chamber 5 communicates via a transverse opening 70 which a pocket-shaped hole 71 which extends from above in the housing part 4''. The pressure valve 14 is arranged in the hole 71 and is composed here of the valve ball 14 which is pressed by its weight against the respective valve seat (shown schematically). The valve seat may be formed as an annular step in the hole 71.

It will be understood that each of the elements described above, or two or more together, may also find a useful application in other types of constructions differing from the types described above.

While the invention has been illustrated and described as embodied in a piston pump, particularly a high pressure piston pump for aggressive and/or abrasive flow media, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A piston pump, particularly a high pressure piston pump for aggressive and/or abrasive and sometimes hot flow media, comprising means forming a suction valve and a pressure valve; means forming a valve through-chamber extending between said suction valve and said pressure valve for passing a flow medium, said valve through chamber having an open end portion, an axis and axially spaced upper and lower ends; means forming a working chamber which is separate from said valve through-chamber and accommodates a displaceable piston; means forming a force-transmitting chamber which partly surrounds said valve through-chamber and communicates with said open end portion and with said working chamber wherein said force transmitting chamber accommodates a force-transmitting medium which transmits energy of displacement of said piston to the flow medium and separates the flow medium from said piston essentially without entering the valve through-chamber so as to perform exclusively force-transmitting functions, said valve through-chamber and said force-transmitting chamber being formed as parts of a common chamber and located substantially concentrically to one another so that the exclusively force-transmitting medium in the force-transmitting chamber displaces concentrically outside of the flow medium in the valve through-chamber without intersection with the latter and wherein the working chamber of the piston being disposed at a vertical distance to the open end portion for preventing the flow medium to penetrate to the piston; a housing block forming said common chamber, said common chamber having a substantially circular cross section, a substantially vertical axis, upper and lower openings coaxial with said axis and leading to said suction valve and said pressure valve, a side opening located near said upper opening and leading to said working chamber; and a pipe coaxial with this axis and extending from said upper opening into said common chamber, said pipe having an open lower end arranged at a distance from said lower opening, said pipe subdividing said common chamber into said valve through chamber located inside said pipe and said force-transmitting chamber outwardly surrounding said pipe.

2. A piston pump as defined in claim 1; and further comprising means for sealing the piston in the working chamber; and means for supplying the force-transmitting medium into the working chamber, the supplying means being arranged in vicinity of the sealing means so that upon introduction of the force-transmitting means any contaminations penetrating to the working chamber and to the sealing means are entrained by the introduced force-transmitting medium so as to provide a cleaning effect.

3. A piston pump as defined in claim 1, wherein said piston is provided with sealing means separated from the flow medium by the force-transmitting medium.

4. A piston pump as defined in claim 1, wherein said force-transmitting chamber extends in a substantially vertical direction.

5. A piston pump as defined in claim 1, wherein said housing block is a one piece member.

6. A piston pump as defined in claim 1; and further comprising a housing block in which said common chamber is formed, and which has an opening, said pipe member having another end portion which is inserted into said opening of said housing block and sealed from said force-transmitting chamber.

7. A piston pump as defined in claim 1, wherein said pipe member is axially fixed to the means forming one of said valves.

8. A piston pump as defined in claim 7; and further comprising a housing block in which said common chamber is formed, the means forming said one valve having a valve casing connected with said housing block, said pipe member being secured to said valve casing.

9. A piston pump as defined in claim 8, wherein said valve casing is mounted on said housing block.

10. A piston pump as defined in claim 8, wherein said valve casing is inserted in said housing block.

11. A piston pump as defined in claim 8; and further comprising a guiding member extending from said one valve to said valve through-chamber, said pipe member being secured to said guiding member.

12. A piston pump as defined in claim 1, wherein said valve through-chamber and said force-transmitting chamber have a vertical axis, said valve through-chamber having an upper open end and said force-transmitting chamber having a lower open end; and further comprising means forming a connecting chamber extending between said upper open end of said valve through-chamber and said lower open end of said force-transmitting chamber so as to form a labyrinth.

13. A piston pump as defined in claim 12, wherein said connecting chamber extends between and concentrically to said valve through-chamber and force-transmitting chamber.

14. A piston pump as defined in claim 12, wherein said means forming said valve through-chamber, force-transmitting chamber and connecting chamber includes two pipe members located concentrically in one another, one of said pipe members extending from below, being upwardly open and bounding said valve through-chamber inside the same, the other of said pipe members extending from above, being downwardly open and bounding said force-transmitting chamber outside the same, said pipe members partially overlapping one another in an axial direction and bounding said connecting chamber therebetween.

15. A piston pump as defined in claim 14; and further comprising a housing block forming said common chamber and having upper and lower openings, each of said pipe members being inserted in a respective one of said openings of said housing block.

16. A piston pump as defined in claim 15; and further comprising sealing means arranged between each of said pipe members and a wall of a respective one of said openings.

17. A piston pump as defined in claim 15, wherein the means forming a respective one of said valves has a valve casing, each of said pipe members being axially secured to a respective one of said valve casings.

18. A piston pump as defined in claim 15; and further comprising two guiding members each communicating a respective one of said valves with said valve through-chamber, each of said pipe members being axially secured to the guiding member of a respective one of said valves.

19. A piston pump as defined in claim 1, wherein said valves are located coaxial with said valve through-chamber.

20. A piston pump as defined in claim 1, wherein said suction valve is located below and said pressure valve is located above said common chamber of said housing block.

21. A piston pump as defined in claim 1, wherein said common chamber has an upright axis, said suction valve being located above and said pressure valve being located below said common chamber.

22. A piston pump as defined in claim 1; and further comprising a housing block forming said common chamber and containing said valve forming means.

23. A piston pump as defined in claim 22, wherein said valve forming means is directly contained in said housing block.

24. A piston pump as defined in claim 22, wherein the means forming each of said valves includes a plurality of components insertable into said housing block.

25. A piston pump as defined in claim 24, wherein said components of the means forming each of said valves includes a valve seat member, a cage member and a pressing member.

26. A piston pump as defined in claim 1; and further comprising a housing block forming said common chamber, said valve forming means being connected with said housing block so as to be accessible from above.

27. A piston pump as defined in claim 26, wherein said valve forming means are arranged on said housing block.

28. A piston pump as defined in claim 26, wherein said valve forming means are arranged in said housing block.

29. A piston pump as defined in claim 1, wherein the means forming at least one of said valves has a valve body which acts in direction of closing of said one valve under the action of gravity.

30. A piston pump as defined in claim 29, wherein said valve body is ball-shaped.

* * * * *